United States Patent [19]

Yokosuka

[11] Patent Number: 4,457,644

[45] Date of Patent: Jul. 3, 1984

[54] BALL-POINT PEN TIP

[75] Inventor: Takehiko Yokosuka, Aichi, Japan

[73] Assignee: Pilot Ink Co., Ltd., Nagoya, Japan

[21] Appl. No.: 331,743

[22] Filed: Dec. 17, 1981

Related U.S. Application Data

[63] Continuation of Ser. No. 109,375, Jan. 3, 1980, abandoned.

[51] Int. Cl.[3] ..... B43K 7/10

[52] U.S. Cl. ..... 401/216; 401/199; 401/208

[58] Field of Search ..... 401/208, 216, 199

[56] References Cited

U.S. PATENT DOCUMENTS

| | | | |
|---|---|---|---|
| 2,834,321 | 5/1958 | Duefrene | 401/216 |
| 2,879,586 | 3/1959 | Fehling | 401/216 |
| 3,162,941 | 12/1964 | Young | 401/216 |
| 4,139,313 | 2/1979 | Hori | 401/216 |

FOREIGN PATENT DOCUMENTS

| | | | |
|---|---|---|---|
| 1808601 | 7/1969 | Fed. Rep. of Germany | 401/216 |
| 2115043 | 10/1972 | Fed. Rep. of Germany | 401/216 |
| 2743888 | 4/1979 | Fed. Rep. of Germany | 401/216 |
| 2854604 | 6/1979 | Fed. Rep. of Germany | 401/216 |
| 1085280 | 7/1954 | France | 401/216 |
| 1088078 | 9/1954 | France | 401/216 |
| 88370 | 12/1966 | France | 401/198 |
| 1559482 | 1/1969 | France | 401/216 |
| 1139038 | 1/1969 | United Kingdom | 401/216 |

*Primary Examiner*—Clyde I. Coughenour

*Attorney, Agent, or Firm*—Sughrue, Mion, Zinn, Macpeak, and Seas

[57] ABSTRACT

A ball-point pen tip provided with a tubular ink guide portion formed of metal. The ink guide portion is formed with radial projections extending radially inwardly produced by the pressing deformation of the metal tube. These projections define capillary channels between neighbouring projections and a ball seat at their radially oriented surfaces. An ink guide stem disposed in the tubular ink guide portion has one end in contact with at least one of the projections, and has the other end confronting with an ink supply stem inserted in a holder. The holder and the ink guide portion provide a socket of the pen tip. Such pen tip is applied to a ball-point pen which includes an ink reservoir adapted to be connected to said ink supply stem. Such ball-point pen employs an aqueous solution based low viscosity ink.

11 Claims, 14 Drawing Figures holder 3 and contacts with an ink guide stem 6 disposed in the ink guide portion 2. The tubular ink guide portion 2 made of metal is formed with a plurality of projections 5 extending radially inwardly. These projections 5 are formed by radially inwardly bending the metal tube 2 at the same circumferential position thereof. A ball 4 is rotatably supported between a ball seat 9 defined by side walls of the protrusions 5 and a tip end of the tubular ink guide portion 2. The tip end is radially inwardly bent.

As shown in FIG. 4, three radially inwardly bent projections 5 define ink passages 8 (capillary channel) therebetween for capillary action.

A second embodiment according to the present invention is shown in FIG. 2, wherein like parts and components are designated by the same reference numerals as those shown in the first embodiment. According to the second embodiment, a tubular ink guide portion 2' made of metal is independently formed with respect to a holder 3' to provide a socket 1' by the combination thereof. A plurality of projections 5 are formed which radially extend into the central axis of the tube 2'. As shown in FIG. 5 the projections 5' are defined by four radially inwardly bent portions between which ink passages 8 are provided. Further, in the tubular ink guide portion 2, a rod having a complicated cross-section as shown in FIGS. 11 through 13 is disposed as an ink guide stem 6'(6'',6'''). The rod is formed with axial clearances to permit ink for creating capillary action.

A third embodiment of this invention is shown in FIG. 3, wherein a tubular ink guide portion 2 is formed integral with a holder 3 to provide an integral socket 1, and further, the ink supply stem is integral with the ink guide stem to provide an integral ink supply stem 7'.

As mentioned the above, the socket 1 or 1' of the present invention can be provided in integral structure, or by connecting the tubular ink guide portion to the holder independently formed relative to the tubular ink guide portion. However, in both cases, at least the tubular ink guide portion should be formed of metal, while the holder is formed of either synthetic resin or metal. Since ink guide portion of the socket is formed in the metal pipe, the ball 4 is sufficiently supported therein, and the ball seat 9 has sufficient wear resistance against rotational contact of the ball for long duration. Further, capillary channels 8 in fluid communication with the ball seat 9 are easily provided by pressing deformation of the metal tube 2 radially inwardly at the same circumferential portion thereof to provide projections 5 extending radially inwardly. The metal for use in the tube 2 is for example, copper alloy such as brass and nickel silver, those being subject to easy machining, or stainless steel which has been considered to be difficult to use due to difficulty in machining.

By the formation of the radial projections 5, radial ink passages 8 (capillary passages 8) are defined, so that ink supply amount can be increased, and ink retainability is enhanced to thus provide uniform ink supplying function into the ball seat without causing any disadvantages such as skipping.

The size and numbers of the protrusions 5 are determined by the diameter of the metal pipe 2, the diameter being determinative by the diameter of the ball 4. Specifically, in order to create capillary action conducted in the spaces between the projections 5, three to six projections are formed, preferrably, three to four projections. The distance between the projections (width of the passages 8) is in a range of about 0.01 mm to 0.6 mm, preferrably 0.02 mm to 0.4 mm.

Further, the ball 4 is an ordinary steel ball or rubby ball. The diameter of the ball 4 is in a range of 0.5 mm to 1.5 mm. Among these, widely used are the balls having diameters of 0.5 mm, 0.7 mm, 0.8 mm and 1.0 mm. The ball 4 is rotatably supported between the ball seats 9 defined by the projections 5 and a tip end of the metal tube 2 radially inwardly bent.

The ink guide stem 6(6') which serves to supply ink into the capillary channels 8 is formed of resin finished fascicular synthetic fibers, or foamed plastic stem or synthetic resin stem. The ink guide stem is preferrably formed or plastic stem in light of easiness of molding. In this case, since the ink is flown through the spaces defined between the inner peripheral surface of the metal tube 2' and the ink guide stem 6' as shown in FIG. 2, the plastic ink guide stem 6' is formed with capillary grooves as at 10 (FIGS. 11 to 13) along the axial direction of the stem 6' in order to ensure introduction of the ink into the capillary passage 8. These grooves 10 are provided by forming the outer surface of the stem 6' in complicated configuration. Such plastic stem 6' is produced by extruding plastic materials such as polyacetal, nylon and cellulose derivatives.

As shown in FIG. 14, a ball-point pen includes a tip portion 11, a pen shaft 12 and an ink reservoir 13. When the ball-point pen tip of the present invention is accomodated in the ball-point pen which uses aqueous solution ink, the ink supply stem 7 serves to introduce the ink from the ink reservoir 13 to the ink guide stem 6, so that the ink supply stem is required to provide sufficient function for supplying sufficient amount of ink in accordance with writing speed. In view of the above, the diameter of the ink supply stem 7 is larger than that of the ink guide stem 6, and the ink supply stem 7 is rod shape, and is formed of resin finished fascicular fibers, or formed of plastic molded articles having continuous bubbles therein, or plastic molded article formed with a plurality of axial bores therein. Since the ink guide stem 7 is formed with a plurality of generally straight axial bores from one end to the other, the stem of the resin-finished fascicular fibers is the most advantageous in terms of the ink transferring speed and supply amount thereof. Such resin finished fascicular fibers is produced by partially bonding fibers with resins, those fibers being nylon or acrylic or polyester synthetic fibers having denier number of 3 to 10d. These fibers are in the form of fascicular oriented along axial direction of the stem 7.

Such ink supply stem has one end inserted into the rear opening of the socket 1 in order to provide surface contact with the ink guide stem 6. Alternatively, the rear end portion of the ink guide stem 6 is thrusted into the ink supply stem 7, or minute clearance is provided between the ink supply stem and the ink guide stem 6.

Further, as shown in FIG. 3, the ink supply stem 7 can be formed integral with the ink guide stem 6 so as to gradually reduce the diameter toward the pen tip. The integral material is, for example, resin finised fascicular fibers or plastic molded article formed with continuous bubbles.

FIGS. 6 through 10 show embodiments showing the various shape of the projections 5 and the ball seat 9. According to the embodiment shown in FIG. 6, the ball seat 9 provides point contact with the ball 4, whereas according to the embodiment shown in FIG. 7 the ball seat 9' provides line contact therewith. Further, accord-

BALL-POINT PEN TIP

This is a Continuation of application Ser. No. 109,375, filed Jan. 3, 1980 (now abandoned).

BACKGROUND OF THE INVENTION

This invention relates to a ball-point pen tip and a ball-point pen provided with the same, and more particularly, to a type thereof which uses an aqueous solution based low viscosity ink.

According to the conventional ball-point pen, a tip portion includes a socket formed of plastic material or metal such as brass and nickel silver, and a steel or rubby-ball rotatably disposed in the tip portion of the socket. Further, an ink guide stem is inserted in the rear portion of the socket, and an ink passage is formed between a ball seat and the ink guide stem.

In this type of the pen tip, the socket must stably hold the ball, even when large writing force is applied to the pen tip. Further, in order to provide confortable writing for long duration, the ball seat must sustain frictional wear due to the rotational surface contact with the rigid ball. Furthermore, ink must be constantly supplied into the ball seat and the ink passage in conformity with the consumption amount of the ink, so that the ink passage must provide sufficient cross-sectional area so as to permit the ink to pass therethrough and must create capillary action for retaining the low viscosity ink therein so as to prevent the ball-point pen from failing to write or skipping.

In case the socket made of plastic material is used, it is possible to produce axial channels, as the ink passages, having complicated cross-sectional shape by molding in order to create sufficient capillary action. However, the ball seat is extremely worn due to rotational contact with the ball, to thus degrade writing performance for long duration. Further, the plastic socket does not provide sufficient force for holding the ball therein in comparison with the metal socket, so that ball may be accidentally released or disengaged from the ball seat during writing.

On the other hand, in case the socket made of metal is used, it would be difficult to produce a plurality of axial channels, as the ink passages, to create capillary action. Generally used are copper alloys such as brass and nickel silver those being easily subject to machining or cutting. However, it is yet difficult to produce axial capillary channels by machining, and resultant socket is costly with low productivity. Further, since brass and nickel silver are apt to be corroded by the aqueous solution ink, the ink to be used must be selected in light of its characteristics such as pH and Cl-ion content, resulting in reducing variety of the aqueous solution ink.

Another type of socket of ball-point pen is proposed in U.S. Pat. No. 3,781,123, wherein a central axial bore having simplified circular cross-section is formed instead of the plurality of axial channels for capillary action. The central bore has one end in communication with radial grooves each having capillary dimension and radially spreading in the surface of the ball seat. However, according to this type, in case the central bore has relatively large diameter so as to supply large amount of ink, reduced is the capillarity for maintaining capillary action of the aqueous solution based low viscosity ink, and therefore, such socket may not be appreciated as a ball-point pen tip which uses aqueous solution ink.

SUMMARY OF THE INVENTION

It is therefore an object of the present invention to overcome the above-mentioned drawbacks and to provide an improved ball-point pen tip and the ball point pen provided with the tip which uses an aqueous solution based low viscosity ink, wherein a socket provides excellent ball retainability and sustains frictional wear due to rotational contact between the ball seat and the ball, yet providing smooth introduction of the ink into the ball seat by the axial capillary channels, to thereby prevent the ball-point pen from failing to write or skipping.

These and other objects are attained in accordance with the present invention by providing a socket comprising a holder formed with openings and a tubular ink guide portion made of metal whose hollow space is in communication with one of the openings of the holder. The tubular ink guide portion is formed with a plurality of protrusions radially inwardly bent toward the central axis of the tube at the same circumferential position thereof by the pressing deformation of the metal tube. Between the neighbouring protrusions, ink passages are radially provided for capillary action. The ball is rotatably supported between the walls of the inwardly bent protrusions and tip end of the tubular ink guide portion with a part of the ball surface being exposed to the atmosphere. Further, the other opening of the holder allows insertion of an ink supply stem therethrough. The ink supply stem is in contact with one end of an ink guide stem disposed in the tubular ink guide portion. The other end of the ink guide stem is in contact with at least one of the protrusions radially inwardly extended.

DETAILED DESCRIPTION OF THE PREFERRED EMBODIMENTS

Figure 1:
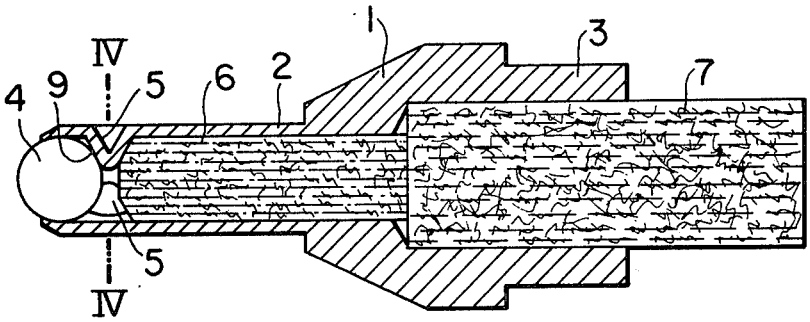
FIG. 1 is a longitudinal cross-sectional view of a ball-point pen tip according to a first embodiment of the present invention.
Figure 2:
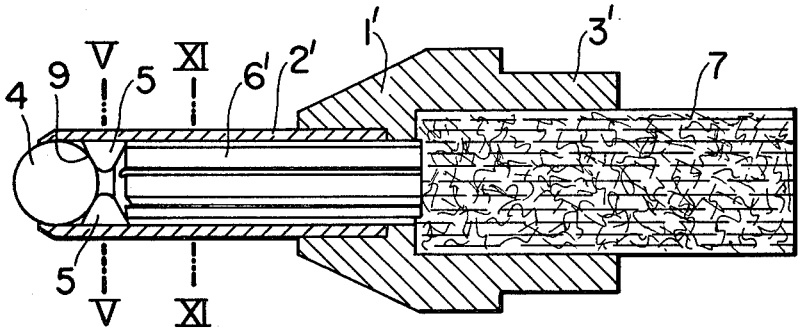
FIG. 2 is a longitudinal cross-sectional view of a ball-point pen tip according to a second emboidment of the present invention.
Figure 3:
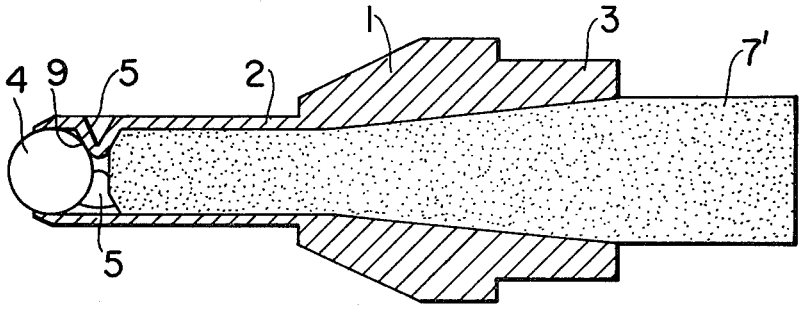
FIG. 3 is a longitudinal cross-sectional view of a ball-point pen tip according to a third embodiment of the present invention.
Figure 4:
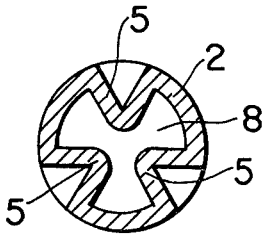
FIG. 4 is a transverse cross-sectional view taken along the line IV—IV of FIG. 1.
Figure 5:
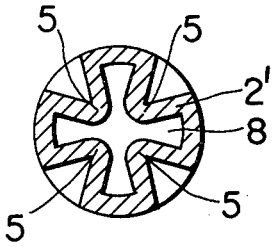
FIG. 5 is a transverse cross-sectional view taken along the line V—V of FIG. 2.
Figure 6:
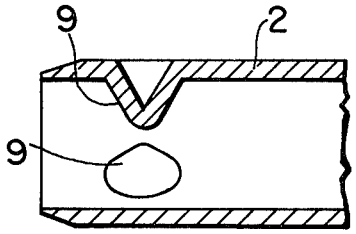
FIGS. 6 thru 10 are longitudinal cross-sectional view of various examples of protrusions extending radially inwardly according to the present invention.
Figure 7:
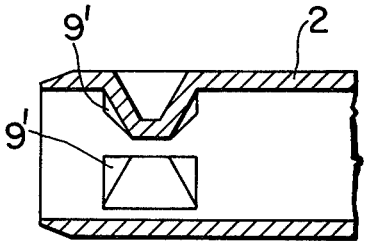
Figure 8:
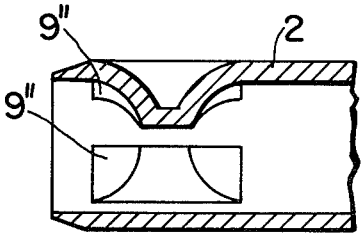
Figure 9:
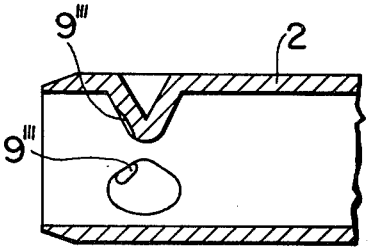

Referring now to the drawings, and initially to FIG. 1, an ink guide portion 2 is integrally formed with a holder portion 3 to define a metal socket 1. An ink supply stem 7 is inserted into a rear opening of the ing to the embodiment of FIG. 9, the ball seat 9''' provides surface contact with the ball 4, as in the case of the embodiment shown in FIG. 8 wherein a ball seat 9'' provide surface contact with the ball 4. In case light or smooth writing performance is required, the contacting area between the ball and the ball seat should be minimized. On the other hand, if the ball-point pen is put much weight on continuous ink lay-down, contacting area between the ball and the ball seat should be large.

Figure 10:
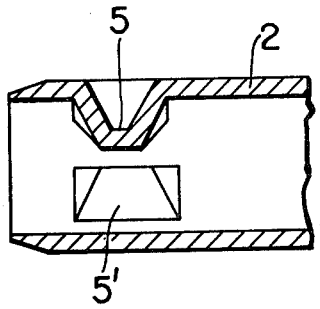
Figure 11:
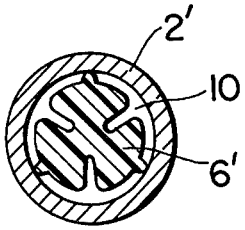
FIG. 11 is a transverse cross-sectional view taken along the line XI—XI of FIG. 2.
Figure 12:
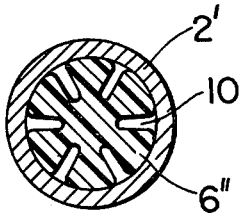
FIGS. 12 and 13 are transverse cross-sectional view showing another embodiments of ink quide stems.
Figure 13:
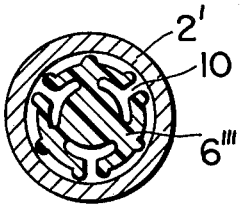
Figure 14:
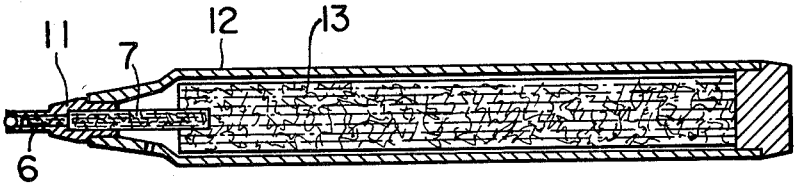
FIG. 14 shows a longitudinal cross-sectional view showing a ball-point pen provided with a ball-point pen tip according to the present invention.

FIG. 10 shows still another embodiment of the protrusions 5, wherein axial length of one of the projections 5' is longer than that of the remaining projections 5 with respect to their rear faces. In this case, since the ink guide stem 6 is contacted with the side face of the longer projections 5', clearance space is formed between the ink guide stem 6 and noncontacting projections 5, so that ink is accumulated in the space. This ink accumulation provides smooth ink supplying action to the ball, to thus avoid ink separation in the ink passages.

While the invention has been described in detail and with reference to specific embodiments thereof, it will be apparent to one skilled in the art that various changes and modifications can be made therein without departing from the spirit and scope thereof.

What is claimed is:

1. A ball-point pen using low viscosity aqueous ink, comprising; a metallic tubular ink guide portion formed with a plurality of radially inwardly extended projections to provide a ball seat and to define ink capillary passages therebetween, a metallic ball having a diameter of 0.5–1.5 mm rotatably secured between said ball seat and tip end of said ink guide portion, a holder having both ends formed with openings and an ink feeder, said ink guide portion being formed of stainless steel having its rear end inserted into one open end of said holder, said ink feeder comprising an ink guide stem formed of plastic rod and, an ink supply stem formed in a rod shape having a larger diameter that that of said ink guide stem and being formed of fascicular fibers partially bonded together with resin, one end of said ink supply stem inserted into the other end of said holder, said ink guide stem disposed in and projecting through said ink guide portion to provide capillary channels defined between said ink guide stem and an inner surface of said ink guide portion, said ink guide stem having one end in contact with said projections but spaced from said ball and the other end in contact with said end of said ink supply stem in said holder to supply low viscosity aqueous ink from said ink supply stem to said ball through said capillary passages.

2. The pen of claim 1 wherein said inwardly extended projections provide point contact with said metallic ball.

3. The pen of claim 1 wherein said inwardly extended projections provide line contact with said metallic ball.

4. The pen of claim 1 wherein said inwardly extended projections provide surface contact with said metallic ball.

5. The pen of claim 1 wherein said fascicular fibers of said ink supply stem are oriented along an axial direction of said ink supply stem.

6. A ball-point pen using low viscosity aqueous ink comprising; a pen shaft, an ink reservoir contained in said pen shaft having a supply of low viscosity aqueous ink, a ball-point pen tip secured in one end of said pen shaft comprising a metallic tubular ink guide portion formed with a plurality of radially inwardly extended projections to provide a ball seat and to define ink capillary passages therebetween, a metallic ball having a diameter of 0.5–1.5 mm rotatably secured between said ball seat and tip end of said ink guide portion, a holder having both ends formed with openings and an ink feeder, the said ink guide portion being formed of a wear resistant metal and its rear end inserted into one open end of said holder, said ink feeder comprising an ink guide stem formed of plastic rod and an ink supply stem formed in a rod shape having a larger diameter than that of said ink guide stem and being formed of fascicular fibers partially bonded together with resin, said ink supply stem having one end inserted into the other open end of said holder and the other end inserted into said ink reservoir, said ink guide stem disposed in and projecting through said ink guide portion to provide capillary channels defined between said ink guide stem and an inner surface of said ink guide portion, said ink guide stem having one end in contact with said projections but slightly spaced from said ball and the other end in contact with the end of said ink supply stem in said holder to supply ink from said ink reservoir through said ink supply stem and said capillary channels into said ink capillary passages to said ball.

7. The pen of claim 6 wherein said inwardly extended projections provide contact with said metallic ball.

8. The pen of claim 6 wherein said inwardly extended projections provide line contact with said metallic ball.

9. The pen of claim 6 wherein said inwardly extended projections provide surface contact with said metallic ball.

10. The pen of claim 6 wherein said fascicular fibers of said ink supply stem are oriented along an axial direction of said ink supply stem.

11. The pen of claim 6 wherein said ink guide portion is formed of stainless steel.

* * * * *